US005566656A

United States Patent [19]

Buchl

[11] Patent Number: 5,566,656

[45] Date of Patent: Oct. 22, 1996

[54] CONTROL SYSTEM FOR A BUTTERFLY VALVE

[75] Inventor: Josef Buchl, Lenting, Germany

[73] Assignee: Audi AG, Ingolstadt, Germany

[21] Appl. No.: 413,123

[22] Filed: Mar. 29, 1995

[30] Foreign Application Priority Data

Apr. 2, 1994 [DE] Germany ..... 44 11 630.6

[51] Int. Cl.[6] ..... F02D 7/00

[52] U.S. Cl. ..... 123/399

[58] Field of Search ..... 123/399, 342, 123/361, 396, 399

[56] References Cited

U.S. PATENT DOCUMENTS 5,259,349 11/1993 Radlinski ..... 123/399
5,323,747 6/1994 Buchl ..... 123/399
5,327,865 7/1994 Riehemann ..... 123/397
5,339,782 8/1994 Golzer et al. ..... 123/399
5,381,769 1/1995 Nishigaki et al. ..... 123/399

*Primary Examiner*—Raymond A. Nelli
*Attorney, Agent, or Firm*—Rosenblatt & Redano PC

[57] ABSTRACT

A control system for a butterfly valve in the intake tract of an internal combustion engine is described. The control system utilizes an actual value sensor to determine the relative position of a motor control part. The actual value sensor changes its sensitivity, using a high resolution only across a part of its total range of movement and a lower resolution across the remainder, allowing the same actual value sensor to be used for idle control and speed control.

14 Claims, 1 Drawing Sheet

CONTROL SYSTEM FOR A BUTTERFLY VALVE

FIELD OF THE INVENTION

The invention relates to a control system for a butterfly valve in the intake tract of an internal combustion engine, and particularly to control systems which integrate the idle and speed controls.

BACKGROUND OF THE INVENTION

Control systems which adjust the idle position of a butterfly valve using electro-mechanical drive assemblies may rely on an actual value sensor to measure the partial tilting of a butterfly valve in relation to the total possible tilting of the valve. Stated differently, an actual value sensor may be used to measure the degree to which a butterfly valve is actually open.

In such control systems, when the actual value sensor is used to measure the degree to which the butterfly valve is open only during idle operations, the relatively small range of movement which must be measured by the actual value sensor allows for accurate measurement at a high resolution. If, however, the actual value sensor is also used to measure the degree to which the butterfly valve is open during the full range of the motor's operations, as when it forms part of a speed control system, a much larger range of movement must be accurately measured. Because of this increased range of movement, the resolution of measurements by the actual value sensor decreases. This requires electronics matched to the evaluation of the butterfly valve position, a relatively expensive process. The invention described below reduces such costs by eliminating the need for adjustments to the electronic system through use of an actual value sensor which retains high resolution during idle adjustments.

SUMMARY OF THE INVENTION

A control system for a butterfly valve in the intake tract of an internal combustion engine is described. The control system utilizes an actual value sensor to determine the relative position of a motor control part. The actual value sensor changes its sensitivity, using a high resolution only across a part of its total range of movement and a lower resolution across the remainder, allowing the same actual value sensor to be used for idle control and speed control.

DETAILED DESCRIPTION OF THE PREFERRED EMBODIMENT

Figure 1:
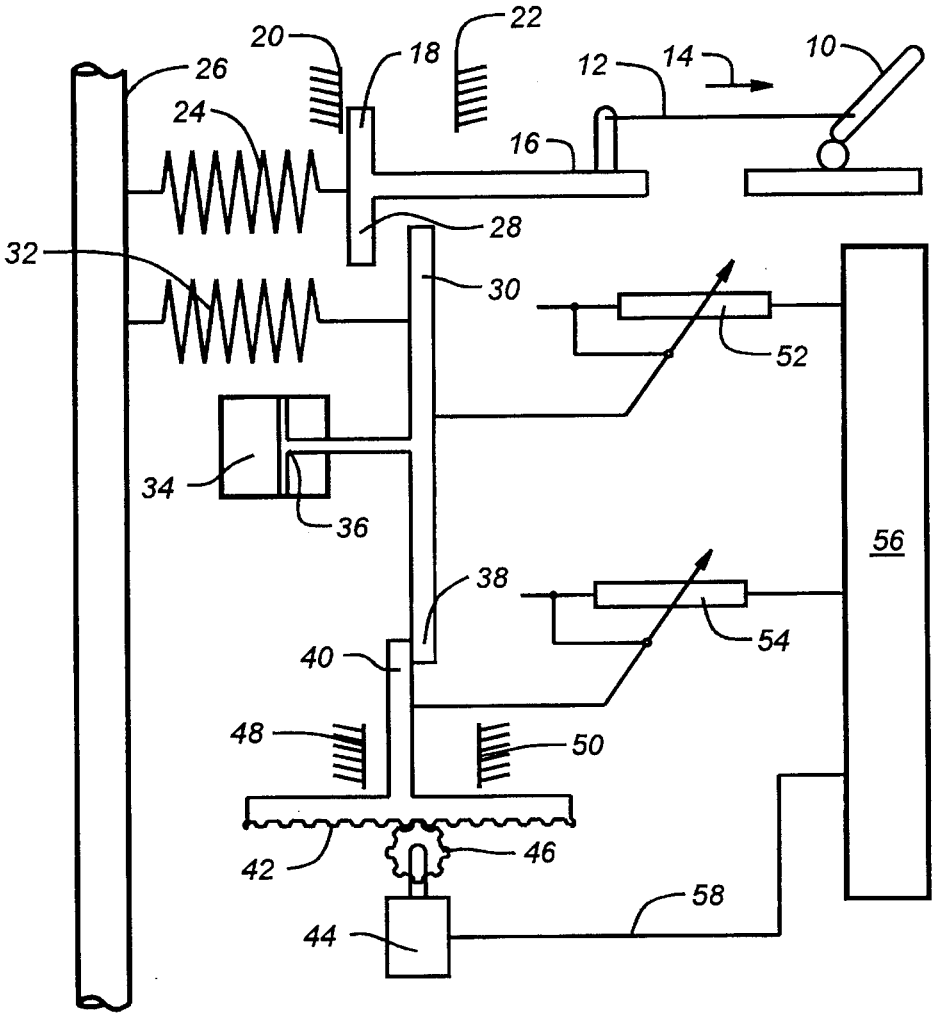
FIG. 1 is a schematic representation of a control system for a butterfly valve in accordance with the present invention.
Figure 2:
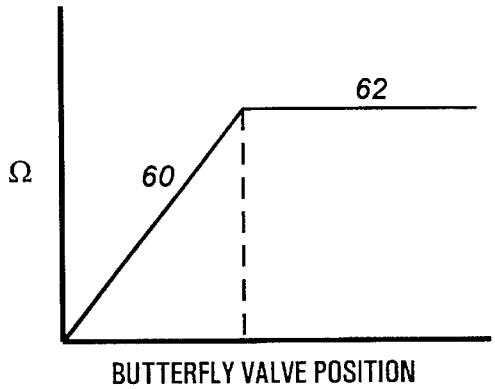
FIG. 2 is an illustration of the characteristic curves of the present invention.

The present invention provides a uniform means of measuring the degree to which a butterfly valve is open regardless of whether the control system is used only during idle operations or is also used for speed control.

Gable 12 is activated mechanically by means of gas pedal 10. When the gas pedal is depressed, the cable 12 moves in the direction indicated by arrow 14.

Adjustment element 16 is attached to cable 12 and is biased, by means of spring 24 attached to fixed element 26, in a direction opposite the direction indicated by arrow 14. This biasing causes stop nose 18 on adjustment element 16 to rest against stop 20 when gas pedal is not depressed. Stop nose 18 also prevents movement of adjustment element 16 beyond stop 22 when the gas pedal is depressed. The path of stop nose 18 between stops 20 and 22 thus represents the maximum movement of adjustment element 16 which may be induced by depressing the gas pedal, and corresponds to the mechanical adjustment path of the butterfly valve.

Activation element 30 is solidly connected to butterfly valve; 36 and opens or closes gate 34, opening or closing the butterfly valve. Activation element 30 is biased in the direction of minimum opening of butterfly valve 36 by means of spring 32 attached to fixed element 26. Cam 28 of adjustment element 30 may selectively engage at least a portion of activation element 30, thereby moving the activation element in the direction opening butterfly valve 36 in response to depressing the gas pedal. With the use of electronic gas pedals, cable 12 would be replaced by an electro-mechanical system which converts the depressing of the gas pedal into movement of activation element 30.

As part of an electro-mechanical adjustment system, adjustment element 40 may similarly move activation element 30 in the direction opening butterfly valve 36 by means of a cam engaging at least a portion 38 of the activation element. For example, adjustment element 40 may be moved by means of a drive 44 such as an electric motor that moves gear 46 acting on gear rack 42, moving the gear rack and adjustment element 40 in a unitary manner. The electro-mechanical adjustment system shown in FIG. 1 includes an electro-mechanical drive assembly comprising adjustment element 40, drive 44, gear 46, gear rack 42, and line 58, as well as activation element 30.

Stop 48 limits movement of adjustment element 40 in the direction corresponding to closing the butterfly valve, and represents the idle position stop. Stop 50 limits movement of adjustment element 40 in the direction corresponding to opening the butterfly valve.

When drive 44 is used only to control the degree of opening of the butterfly valve during idle operation, stop 50 may be positioned in such a manner that it prevents movement of adjustment element 40 beyond a position corresponding to the maximum open position of the butterfly valve during idle operation. When drive 44 is also used as part of a speed control system, stop 50 may be positioned in such a manner that it prevents movement of adjustment element 40 beyond a position corresponding to the maximum opening of the butterfly valve at full load position.

Evaluation electronics 56, provided to control drive 44, obtains information from actual value sensors 52 and 54, which determine the actual position of activation element 30 and adjustment element 40 respectively. The actual value sensors may be potentiometers, with movement of activation element 30 or adjustment element 40 being transferred to the collector ring of the potentiometer 52 or 54. The resistance value of potentiometer 52 or 54 is then measured by evaluation electronics to ascertain the actual position value.

The elements described function as follows: when gas pedal 10 is depressed in the direction of arrow 14, adjustment element 16 is pulled in the direction of the arrow against the bias provided by spring 24; activation element 30 is pushed against the bias provided by spring 32 by means of cam 28 in a direction that opens butterfly valve 36.

When gas pedal 10 is not depressed, nose 18 of adjustment part 16 rests against stop 20 and the position of butterfly valve 36 is set by means of an idle control and drive 44.

Evaluation electronics 56 controls drive 44 by way of line 58, moving adjustment element 40 to the right or the left (as shown in the schematic representation of FIG. 1) to control the position of butterfly valve 36. Movement of adjustment element 40 to the right as shown in FIG. 1 causes cam 38 to push activation element 30 against the bias provided by spring 32 in a direction that opens butterfly valve 36.

Movement of adjustment element 40 to the left as shown in FIG. 1, and hence the minimum degree of opening of butterfly valve 36, is limited by stop 48. When adjustment element 40 rests against stop 48, activation element 30 is in the position corresponding to the least degree of opening of butterfly valve 36. This prevents mechanical wedging which could be caused by closing butterfly valve 36 too far or by wedging of the adjustment elements 16 and 40. As indicated earlier, stop 50 limits the movement of adjustment element 40 to the right as shown in FIG. 1. When adjustment element 40 rests against stop 50, activation element 30 is in the position corresponding to the greatest degree of opening of butterfly valve 36 which can be achieved using drive 44. Further opening of butterfly valve 36 is only possible by depressing gas pedal 10.

The degree of opening of butterfly valve 36, between the minimum idle position and the maximum operating position, varies through an angle of approximately 90°. Actual value sensor 52 is required to scan the entire movement path of activation element 30 corresponding to the entire range of opening of the butterfly valve 36. When drive 44 is used only to adjust the opening of the butterfly valve during idle operations, actual value sensor 54 need only scan the movement path of adjustment element 40 corresponding to the range of opening of the butterfly valve 36 in idle operations, which varies through an angle of approximately 25°. Under such circumstances actual value sensor 54 is capable of relatively accurately scanning the position of adjustment element 40 and provides accurate information to evaluation electronics 56 for the control of butterfly valve 36 by means of line 58 and drive 44.

When drive 44 is used not only to adjust the idle position of butterfly valve 36, but also to position butterfly valve 36 anywhere within its maximum range of opening, as when drive 44 forms part of a speed control unit, actual value sensor 54 is required to scan the entire movement path of activation element 30 corresponding to the entire range of opening of the butterfly valve 36. Actual value sensor 54 must therefore deliver values to evaluation electronics 56 for positions of adjustment element 40 outside the positions corresponding to idle operations. It is therefore necessary to fit vehicles equipped with a speed control unit with different evaluation electronics 56 than vehicles which are not equipped with a speed control units. Actual value sensor 54 must also be designed differently since only the range of motion between the minimum and maximum idle positions of the butterfly valve (the first 25° or so of the butterfly valve angle) must be measured accurately for vehicles in which drive 44 serves only to adjust the idle position of the butterfly valve; vehicles equipped with a speed control unit, on the other hand, must be fitted with actual value sensors which scan the entire operating range (the entire butterfly valve angle of approximately 90°).

To avoid the need for different actual value sensors 54 and evaluation electronics 56 depending on whether the vehicle is equipped with a speed control unit, an actual value sensor with two different sensitivities may be used. The actual value sensor thus has two different characteristic curves 60, 62 corresponding to movement of the butterfly valve within two contiguous ranges of positions between the minimum idle position and the maximum operating position. The first characteristic curve 60 corresponds to movement of the butterfly valve 36 during idle operations, between the minimum and maximum idle positions of the butterfly valve. The second characteristic curve 62 corresponds to movement of the butterfly valve 36 beyond a predetermined position representing the upper limit of idle operations, the maximum idle position of the butterfly valve. The second characteristic curve may yield a generally constant value independent of the position of adjustment element 40.

Such an actual value sensor may, for example, be a potentiometer whose resistance only changes significantly with movement of adjustment element 40 within the range corresponding to an idle adjustment of butterfly valve 36. Such a potentiometer would change resistance, preferably in a linear manner, across the range of movement of adjustment element 40 which corresponds to idle operations of the butterfly valve (a range of positions from 0° to approximately 25°). Further movement of adjustment element 40, corresponding to butterfly valve positions outside the range of idle operations (a range of positions from approximately 25° to approximately 90°) would not cause any change in the resistance of the potentiometer, or would cause only a minor change. The potentiometer's change in sensitivity may occur as the butterfly valve is moved in either direction past a predetermined position corresponding to the upper limit of idle operations. Thus the same potentiometer and evaluation electronics could be used in both vehicles equipped with speed control units and those which are not so equipped.

In practice, the potentiometer 54 as described above may be designed by simply be short circuiting the portion of the resistance path which corresponds to measurements outside the range of idle operations, such that further sliding of the collector ring on the resistance path beyond position corresponding to the limit of idle operations does not change the measured resistance value.

It is also possible to prevent the collector ring from moving further once adjustment element 40 reaches a position corresponding to a butterfly valve angle of approximately 25°, so that potentiometer 54 changes its resistance value only between butterfly valve angles of O° and 25°. However the mechanical devices required for such a solution (e.g., a mechanical release) are more involved than simply short circuiting the resistance path and are therefore more expensive.

The actual value sensor need not be limited to mechanical links to the butterfly valve. A non-contact actual value sensor could be designed, for example, by a magnetic element associated with the butterfly valve and a hall sensor which senses the position of the magnetic element. Movement of the butterfly valve is detected by the hall sensor via magnetic coupling, and the signal from the hall sensor is electrically filtered so that only signals corresponding to idle adjustment of the butterfly valve are transmitted to the evaluation electronics.

It will be understood by those of ordinary skill that the foregoing disclosure and description of the invention are illustrative and explanatory thereof, and various changes in the size, shape and materials, as well as in the details of the illustrated construction, may be made without departing from the spirit of the invention.

I claim:

1. A control system for a butterfly valve in the intake tract of an internal combustion engine fitted with (a) a gas pedal connected to an adjustment element, (b) an activation element capable of being moved in an opening direction by a cam on the adjustment element, the adjustment element connected to the butterfly valve and controlling the degree of opening of the butterfly valve, (c) an electro-mechanical adjustment system capable of being activated by drive and fitted with a cam capable of moving the activation element in the opening direction of the butterfly valve, (d) an impact device pulling the activation element in the closing direction of the butterfly valve, causing the activation element to rest against the cam of either the adjustment element or the electro-mechanical adjustment system, (e) a minimum idle stop limiting movement of the electro-mechanical adjustment system in the closing direction of the butterfly valve, (f) a full load stop limiting movement of the activation element in the opening direction of the butterfly valve, (g) a first actual value sensor monitoring movement of the activation element, and (h) evaluation electronics receiving signals from the first actual value sensor, said first actual value sensor having a first characteristic curve and a second different characteristic curve across the total range of movement of the butterfly valve.

2. The control system of claim 1 wherein said actual value sensor is a potentiometer comprising a collector ring moving along a resistance path, wherein at least a portion of said resistance path is short-circuited.

3. The control system of claim 2 wherein the portion of said resistance path which is not short circuited corresponds to idle operations of said butterfly valve.

4. The control system of claim 1 wherein said actual value sensor is a potentiometer comprising a collector ring moving along a resistance path, wherein said collector ring is prevented from moving further along said resistance path once said butterfly valve is moved past a predetermined position.

5. The control system of claim 4 wherein said predetermined position corresponds to the upper limit of idle operations.

6. The control system of claim 1 wherein said second characteristic curve is a generally constant value.

7. The control system of claim 1 wherein said second characteristic curve is independent of the position of the butterfly valve.

8. The control system of claim 1 wherein said first actual value sensor is a potentiometer.

9. The control systems of claim 8 wherein said potentiometer has a collector ring, a portion of said collector ring corresponding to said second characteristic curve being shorted.

10. The control system of claim 1 wherein said first actual valve sensor is a potentiometer whose resistance changes significantly only when said butterfly valve is moved within a first range of positions.

11. The control system of claim 10 wherein said first range of positions corresponds to idle operations.

12. The control system of claim 10 wherein said actual value sensor is a potentiometer whose resistance does not change significantly when said butterfly valve is moved beyond said first range of positions.

13. The control system of claim 1 wherein said first characteristic curve corresponds to positions of the butterfly valve during idle operations.

14. The control systems of claim 1 further comprising a second actual value sensor monitoring movement of the electro-mechanical adjustment system and operatively connected to the evaluation electronics.

* * * * *